US007731329B2

(12) United States Patent
Yearout et al.

(10) Patent No.: US 7,731,329 B2
(45) Date of Patent: Jun. 8, 2010

(54) DRUM-MOUNTED ROLLER SPITTOON SYSTEM AND METHOD

(75) Inventors: Russell P. Yearout, Brush Prairie, WA (US); Antonio Gomez, Vancouver, WA (US); Alan Shibata, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 775 days.

(21) Appl. No.: 11/601,915

(22) Filed: Nov. 20, 2006

(65) Prior Publication Data

US 2008/0117253 A1 May 22, 2008

(51) Int. Cl.
*B41J 2/165* (2006.01)

(52) U.S. Cl. ..... 347/36; 347/35

(58) Field of Classification Search ..... 347/31–32, 347/35–36

See application file for complete search history.

(56) References Cited

U.S. PATENT DOCUMENTS 5,617,124 A 4/1997 Taylor et al.
6,247,783 B1 6/2001 Shibata et al.
6,273,547 B1 8/2001 Aldrich
6,340,220 B1 1/2002 Gaylor et al.
6,375,304 B1 4/2002 Aldrich et al.
6,629,750 B2 10/2003 Ciordia
6,663,215 B2 12/2003 Klausbruckner et al.
6,733,106 B1 5/2004 Leemhuis
6,880,912 B2 4/2005 Klausbruckner et al.
6,932,455 B2 8/2005 Monclus et al.
2002/0018081 A1 2/2002 Seu et al.
2003/0227503 A1 12/2003 Klausbruckner et al.
2004/0218003 A1 11/2004 Monclus et al.
2004/0257397 A1 12/2004 Gomez et al.
2005/0162458 A1 7/2005 Gaston et al.
2005/0270327 A1 12/2005 Brookmire et al.

FOREIGN PATENT DOCUMENTS

GB 2410216 A 7/2005
JP 2002361879 A * 12/2002 ..... 347/33

OTHER PUBLICATIONS

International Search Report for Application No. PCT/US2007/085052. Report issued Apr. 29, 2008.

* cited by examiner

*Primary Examiner*—Julian D Huffman
*Assistant Examiner*—Jason S Uhlenhake

(57) ABSTRACT

Various embodiments of a system and method for spitting are disclosed.

18 Claims, 4 Drawing Sheets

DRUM-MOUNTED ROLLER SPITTOON SYSTEM AND METHOD

BACKGROUND

Inkjet printing mechanisms use cartridges, often called "pens," which eject drops of ink onto a page. Each pen has a print head formed with very small nozzles through which the ink drops are fired. Drum-type ink jet printing systems generally include one or more print heads disposed over a rotating cylindrical drum. The print media is carried by the rotating drum past the print heads, which eject drops of ink in a desired pattern upon the media.

In order to maintain good image quality, proper maintenance of the condition of the print heads is desirable. An improperly maintained print head can become clogged and/or become the source of dot placement errors that reduce print quality. To that end, inkjet printing devices also typically include a print head service station, generally located outside the print zone, to allow cleaning and protection of the print heads. Print head service stations usually include a waste ink collector, called a "spittoon", into which a number of drops of ink are periodically ejected, or "spit", from each nozzle to flush out drying ink. If spitting is not performed, the first few drops ejected from each nozzle can have poor trajectory or be of low optical density, resulting in visible image or print quality defects.

In many printing systems, the print head assembly moves from the print zone to the service station for print head servicing during non-printing periods and during the shutdown process. However, speed is a desirable printing consideration. Moving the print heads from the print zone (above the drum) to a service station that is off the drum, and then back again is a relatively slow process, which increases downtime and reduces throughput of the printing system. Additionally, moving the print heads to a service station outside the print zone can introduce print head position errors, which can harm print quality.

BRIEF DESCRIPTION OF THE DRAWINGS

Various features and advantages of the invention will be apparent from the detailed description which follows, taken in conjunction with the accompanying drawings, which together illustrate, by way of example, features of the invention, and wherein.

DETAILED DESCRIPTION

Figure 1:
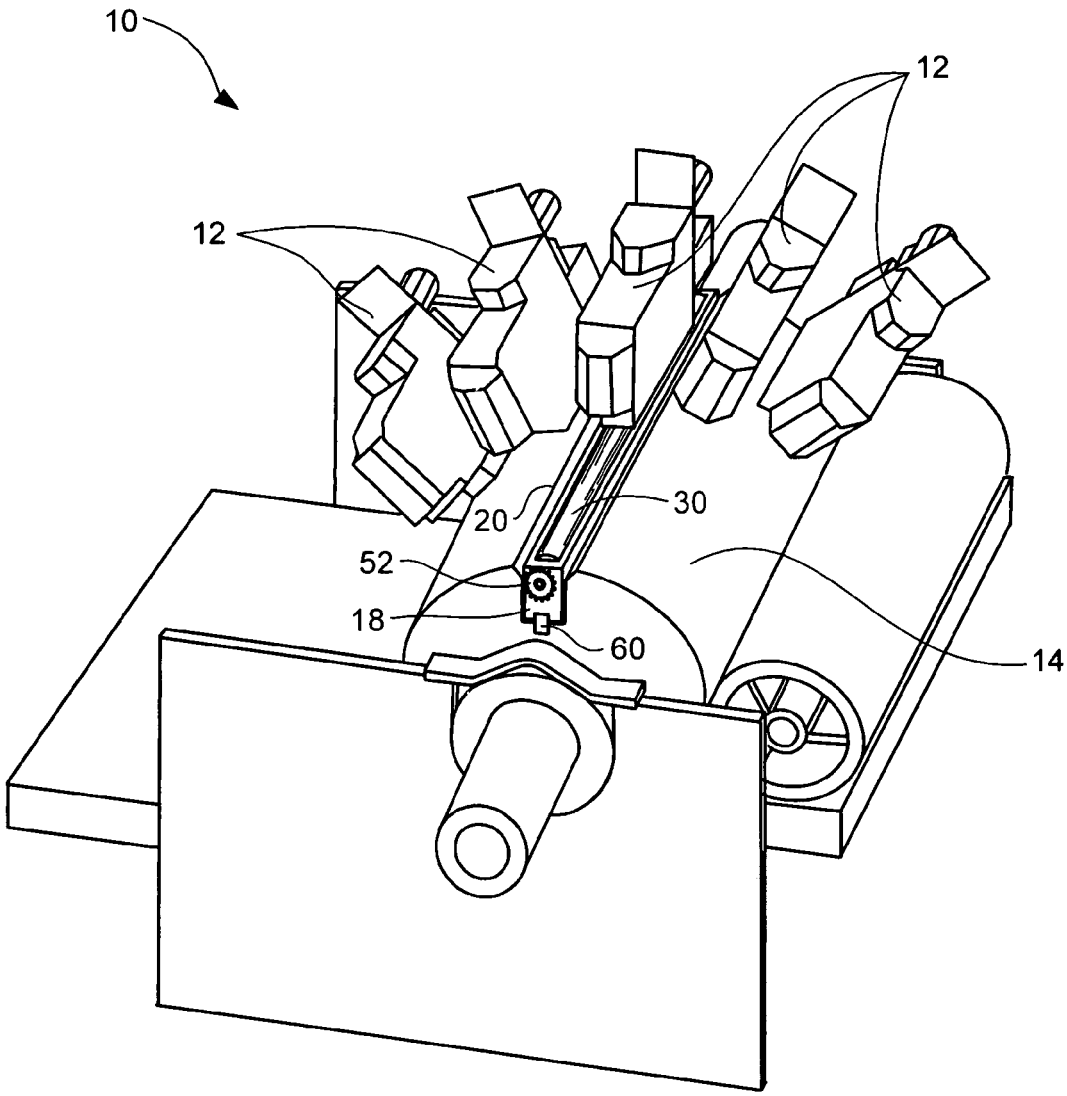
FIG. 1 is a perspective view of a portion of an image forming device having one embodiment a drum-mounted roller spittoon in accordance with the present disclosure.

Reference will now be made to exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the invention as illustrated herein, which would occur to one skilled in the relevant art and having possession of this disclosure, are to be considered within the scope of the invention.

Figure 2:
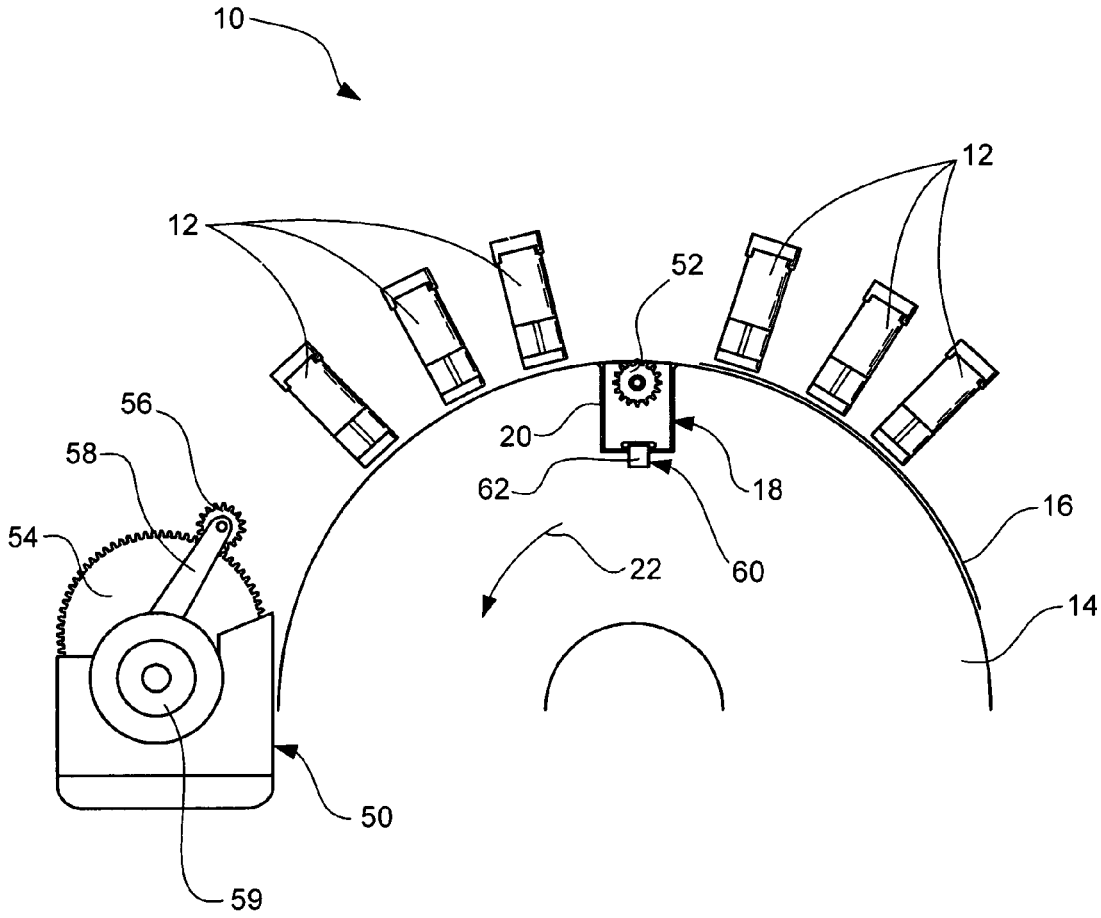
FIG. 2 is a partial side view of another embodiment of a printer system having a printer drum with a roller spittoon mounted thereon.

The present disclosure relates generally to servicing of ink jet nozzles in drum-type ink jet printers. These types of printers are often considered "high end" printers, and can be configured to print about 30 pages per minute or more. Drum-type printers can make up the heart of an office printer or copier machine, or they can be photographic quality printers, for example. As shown in FIGS. 1 and 2, a drum-type printer 10 generally includes one or more print heads or pens 12 positioned over a rotating drum 14, which rotates and carries pages of print media (16 in FIG. 2) past the print head(s). The number of print heads can vary. For example, in the printing system shown in FIG. 1, there are five print heads, while the embodiment shown in FIGS. 2 and 3 includes six print heads. The print media can be adhered to the drum via vacuum pressure or other known methods. These types of printers can be configured to print onto the print media in one or more passes, and in one direction or bidirectionally (i.e. printing can occur with the drum rotating clockwise and then counterclockwise in one or more sequences).

As noted above, in order to maintain good image quality, it is desirable that the print heads be ready to print at all times, for which periodic (e.g. between successive pages) decap spitting into some sort of waste ink collector is desirable to flush out drying ink from the nozzles. If decap spitting is not performed, the first few drops ejected from each nozzle can have poor trajectory or be of low optical density, resulting in visible image or print quality defects. One approach to this issue has been to provide "spit strips" at the top of each page of print media. Before printing an image on the page, all ink nozzles fire upon this spit strip so as to keep the nozzles ready. Unfortunately, since spit strips are visible on the printed page, they are generally undesirable to users. Another approach has been to eliminate spitting altogether, which, unfortunately, does not address the issue, but merely ignores it.

With drum-type printers, it is generally considered impractical to interrupt printing by moving the print heads to a position off the drum to perform the decap spitting. As is apparent from the embodiment of FIG. 1, in drum-type printers, the print heads 12 can be fixed in position relative to the drum 14. This helps ensure accuracy in ink placement. Configuring this type of printer with moveable print heads to allow them to be moved off the drum for spitting can affect image quality due to possible inaccuracy in repositioning the print heads following a spitting operation. Accuracy of positioning of the print heads is of particular concern in bidirectional printing because the image quality can suffer if the print head position varies from one pass to the next. Moving the print heads away from the print zone for a spitting operation can also significantly reduce printer throughput.

Advantageously, the inventors have developed a drum-mounted roller spittoon system that allows decap spitting as often as desired without the need to move the print heads out of the print zone. Embodiments of a drum-type printer 10 having a drum-mounted roller spittoon system in accordance with the present disclosure are shown in FIGS. 1 and 2. In both embodiments, a roller spittoon cartridge 18 is removably mounted in a channel 20 in the printer drum 14. The roller spittoon provides a spitting surface onto which decap ink can be spat by each print head 12 as the drum rotates and the roller spittoon passes the print head. In FIG. 2 the drum is illustrated as revolving counterclockwise (in the direction of arrow 22), causing the roller spittoon to pass each print head with each revolution of the drum. A spitting operation can take place with each revolution of the drum, if desired.

Figure 4:
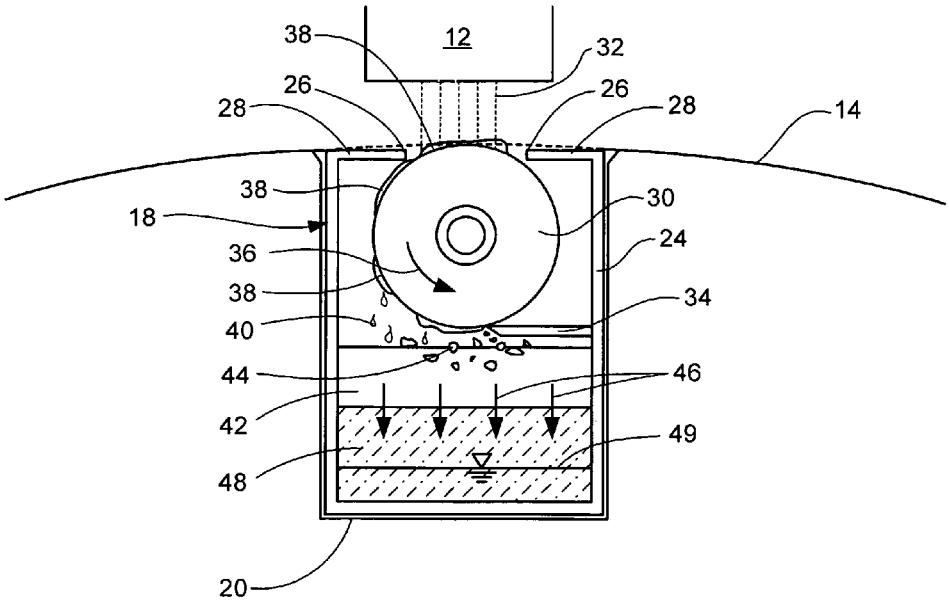
FIG. 4 is an end cross-sectional view of an embodiment of a roller spittoon cartridge in accordance with the present disclosure.
Figure 5:
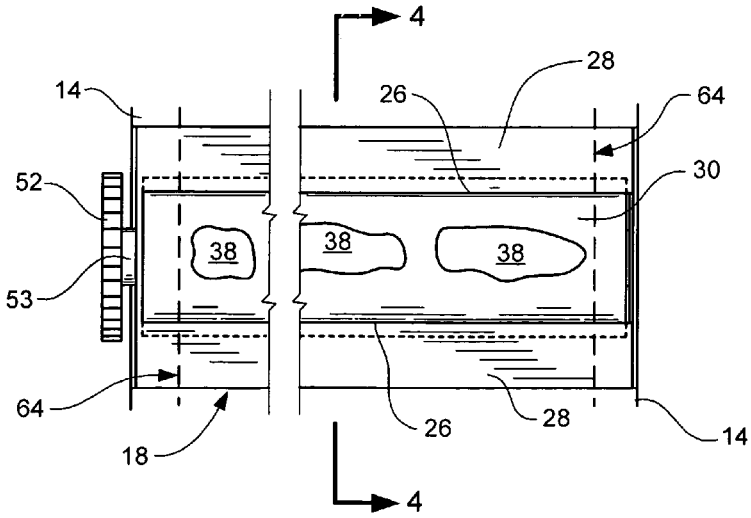
FIG. 5 is a partial top view of an embodiment of the roller spittoon cartridge of FIG. 4 mounted in a drum of a printer system.

Various views of one embodiment of a roller spittoon cartridge are shown in FIGS. 4 and 5. The roller spittoon cartridge 18 generally includes an elongate body or housing 24, which has an elongate opening 26 in its top surface 28. An elongate cylindrical roller 30 is rotatably disposed within the body such that a portion of the roller surface is exposed through the elongate opening. The roller is positioned and configured to receive waste ink material, represented by dashed lines 32, that is ejected from a print head 12. The roller can be an aluminum tube that is treated (e.g. anodized) or coated (e.g. with Teflon) to make it easier to scrape ink from the roller.

The roller spittoon cartridge 18 also includes an ink collecting structure, located adjacent to the roller 30 and opposite the opening 26. The ink collecting structure can take a variety of forms. In the embodiment shown in FIGS. 4 and 5, the ink collecting structure includes a sharp edged scraper 34, which contacts the roller with sufficient force to scrape dried or partially dried ink residue from the surface of the roller. As the roller rotates in the direction of arrow 36, accumulations of waste ink 38 rotate away from the opening 26 and down into the roller spittoon body. During rotation, liquid ink drops 40 (if any) can drip from the roller, while the scraper 34 mechanically scrapes dried or partially dried ink from the roller surface.

Below the scraper 34 is a capillary absorber 42. The capillary absorber can be a piece of felt material such as polyester, or a piece of foam or cellulose type material. Bits of dried or partially dried ink 44 that have been scraped from the roller will naturally fall upon and be captured by the capillary absorber. Liquid ink residue, on the other hand, is drawn downward (in the direction of arrows 46) by capillary action to the main waste ink absorber/reservoir 48 that is located below the capillary absorber. The main waste ink absorber can be a piece of felt material, such as polyester, or a piece of foam or cellulose type material. The absorber can fill the entire lower space of the roller spittoon cartridge, or this space can include an empty space (not shown) below the absorber. Whether there is an open reservoir space, or the absorber/reservoir space is occupied by the absorber material, this region acts as a reservoir for liquid ink, represented by liquid surface 49. The liquid ink is prevented from spillage when the drum rotates by virtue of the absorbent material.

Figure 3:
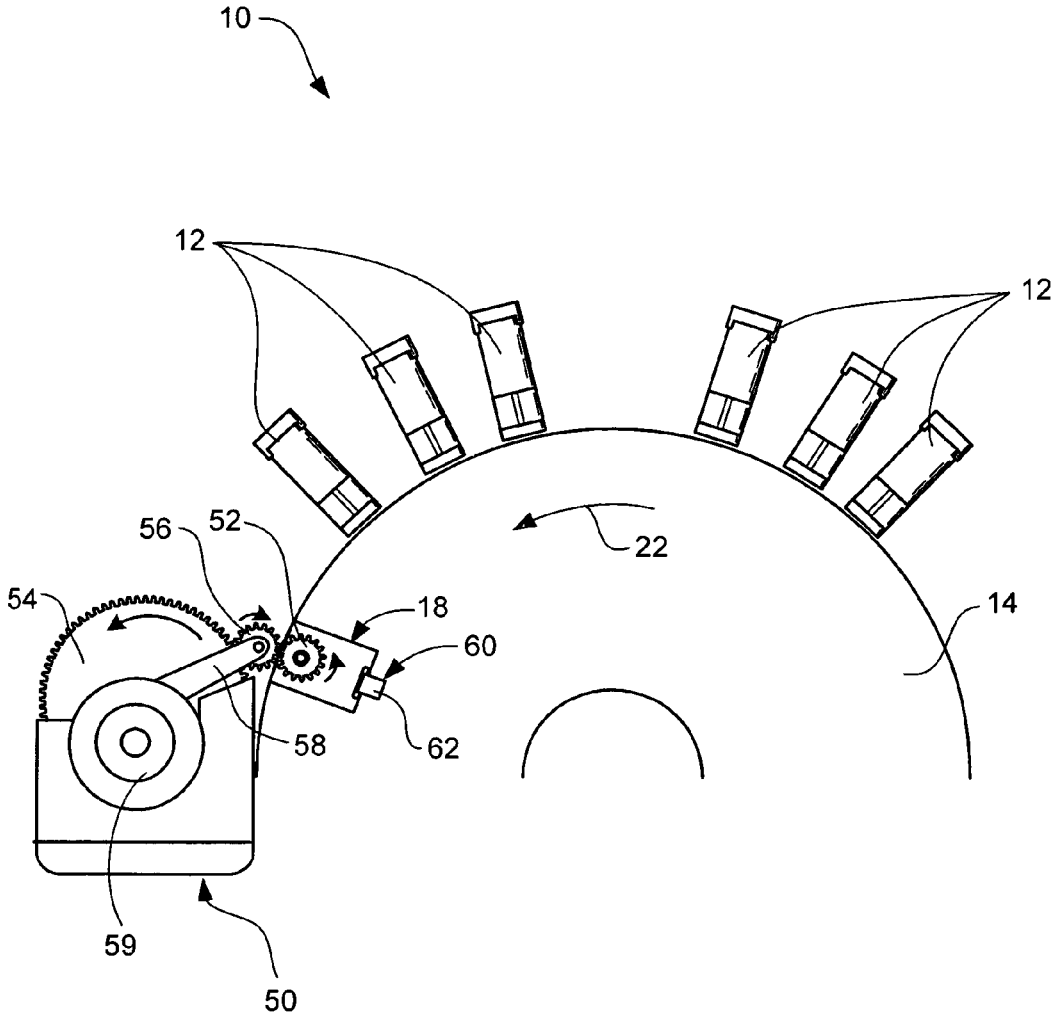
FIG. 3 is a partial side view of the printer system of FIG. 2, with the roller spittoon rotated to the engagement position.

During normal operation of the printer, the roller 30 remains stationary as the roller spittoon cartridge 18 passes each print head 12 in succession. Each print head can spit waste ink onto the exposed surface of the roller as the roller spittoon cartridge passes. The roller rotates when it periodically engages with a roller drive mechanism 50, as shown in FIG. 3. The roller spittoon cartridge includes an engagement mechanism for mechanically engaging the roller with the roller drive mechanism. In the embodiment shown in FIGS. 1, 2 and 4, the engagement mechanism includes a roller gear 52, which is connected to the axle (53 in FIG. 5) of the roller 30. The drive mechanism includes a drive gear 54 and a planet gear 56, mounted to a moveable drive arm 58, and a motor 59.

The planet gear 56 is in mechanical engagement with the drive gear 54. When the drive arm 58 is rotated away from the drum, as shown in FIG. 2, the roller drive mechanism will not affect the roller spittoon assembly as it passes by with rotation of the drum 14. However, at selected intervals when it is desired to clean the roller, the drum is first rotated to the position shown in FIG. 3, with the roller spittoon cartridge 18 located adjacent to the roller drive mechanism. The roller drive mechanism is aligned so that, with the roller spittoon in this position, when the drive arm is rotated toward the roller spittoon cartridge, the planet gear will mechanically engage the roller gear 52.

The drive arm 58 and drive gear 54 can be actuated by a motor 59 that, when operated in one direction moves the swing arm toward the drum 14 and the roller spittoon cartridge 18 to engage the roller gear 52 for scraping of the roller, and when operated in the opposite direction retracts the drive arm from that position, thus disengaging from the roller gear. In the position shown in FIG. 3, counterclockwise rotation of the drive gear will cause counterclockwise rotation of the roller gear, and thus, of the roller.

It will be apparent that other types of selective mechanical drive and engagement mechanisms could also be employed to selectively engage the roller with a drive mechanism. For example, a releasable clutch mechanism could be used to selectively interconnect the roller with a drive motor. Other alternatives are also possible. For example, a portion of a ring gear could be affixed adjacent to the drum and positioned to engage the roller gear 52 during each rotation of the drum 14.

When the roller 30 is engaged with the drive mechanism 50 and rotates as described above, waste ink material will be scraped from the roller and transferred to the ink collecting structure. The frequency of advancing of the roller can vary. For example, advancing the roller to clean it can be performed with each revolution of the drum. Alternatively, roller cleaning can happen less often, even if spitting occurs more frequently. For example, engagement of the roller for cleaning can be performed at the end of each print job, rather than with each revolution of the drum. In some circumstances, the inventors anticipate rotating the roller after every 30 to 50 printed pages. When the roller remains stationary for multiple spit passes, this can cause the waste ink 38 to build up on the roller. Such accumulation over time is not a concern so long as the build up of waste ink is not so thick as to contact the print heads on subsequent revolutions of the drum, and is not so thick as to contact the edges of the opening 26 in the top of the roller spittoon cartridge when the roller is advanced. It will be apparent that such build up of waste ink will occur faster with more viscous inks, and scraping and removing more viscous inks from the roller is likely to involve more force.

Advantageously, the roller spittoon cartridge 18 is removable from the printing drum 14. As shown in FIGS. 1 and 2, the roller spittoon cartridge fits into a transverse channel 20 in the drum. A variety of types of removable latch or mechanical connection methods can be used to attach the cartridge to the drum. For example, as shown in FIGS. 1 and 2, the cartridge can be held in place by a mechanical latch 60. The latch can be a spring-loaded lever, configured to hold the cartridge laterally in the channel, while corresponding interlocking channel structure can be associated with both the channel and the cartridge body to resist vertical motion of the cartridge within the channel. The latch 60 can include a lever end 62 that allows a user to release the latch by pressing the lever end and withdraw the cartridge. Other releasable connection methods can also be used.

Given the easy removability of the roller spittoon cartridge 18, once sufficient ink has been collected in the spittoon cartridge, it can be easily removed from the drum and replaced with a clean spittoon cartridge. Spittoon systems associated with ink jet printing systems frequently employ a drop counter that counts drops that are spit into a spittoon system. Such drop counters can be associated with each print head in the present system, and can count drops of ink spit onto the roller. When a preset spit threshold is reached, the printing system can provide a message or indication to a user, informing the user that the spittoon is full and prompting the user to replace it. It will be apparent that if too much waste ink is transferred to the ink collecting structure, ink spillage or other undesirable consequences are possible. To prevent this, the spit threshold can be set to a level that allows additional operation of the printing device before ink spillage or other undesirable situations arise, providing a comfortable window for printer maintenance activities.

As shown in FIGS. 1 and 5, the roller spittoon cartridge 18 can be substantially as wide as the drum 14, so that the print heads can spit as the spittoon passes, regardless of their printing position (i.e. lateral position with respect to the width of the drum). Alternatively, the roller spittoon cartridge can be configured so that the roller 30 and the opening 26 in the top of the cartridge are at least as wide as the print region, being the area bounded by dashed lines 64 in FIG. 5. The print region represents the maximum width area of the drum that can be occupied by print media.

The inventors have thus developed a removable drum-mounted roller spittoon cartridge that is compatible with a wide variety of types of inks. With each rotation of the drum (or less frequently, if desired), the pens can spit onto the roller surface. Advantageously, the spit roller can be as wide as the drum, or as wide as the print media (paper), so that the print heads can spit whenever the spittoon passes, regardless of their printing position. The roller spittoon includes a roller gear, a scraper, and an absorber/reservoir. The roller gear is periodically rotated by an external drive system, causing the spit roller to rotate against a scraper within the roller spittoon cartridge, to remove ink from the surface of the roller, and transfer liquid ink residue to the absorber/reservoir. Once sufficient ink has been collected in the spittoon cartridge, it can be removed from the drum and replaced with a clean spittoon cartridge It is to be understood that the above-referenced arrangements are illustrative of the application of the principles of the present invention. It will be apparent to those of ordinary skill in the art that numerous modifications can be made without departing from the principles and concepts of the invention as set forth in the claims.

What is claimed is:

1. An ink spittoon system for an ink jet printer having a media drum configured to rotate past at least one ink jet print head, comprising:

a roller spittoon assembly, attached to the drum, having a roller for receiving ink spit from the at least one ink jet print head;

a roller gear, attached to the roller; and a drive mechanism, having a selectively engageable gear drive, configured to engage the roller gear and transmit driving force thereto when the roller spittoon assembly is adjacent to the drive mechanism.

2. An ink spittoon system in accordance with claim 1, wherein the roller spittoon assembly spans substantially a full width of the media drum.

3. An ink spittoon system in accordance with claim 1, wherein the roller spittoon assembly is removable from the media drum.

4. An ink spittoon system in accordance with claim 3, wherein the media drum further comprises a transverse channel, the roller spittoon assembly being disposed in the channel, and further comprising a releasable mechanical latch, interconnecting the roller spittoon assembly within the channel.

5. An ink spittoon system in accordance with claim 1, wherein the roller spittoon assembly further comprises:

an elongate body, removably mountable upon the media drum;

a top portion of the roller being exposed to the print head and configured to receive waste ink material ejected therefrom;

an ink collecting structure, disposed in the body below the roller; and the drive mechanism being configured to rotate the roller to transfer waste ink material from the roller to the ink collecting structure.

6. An ink spittoon system in accordance with claim 5, wherein the ink collecting structure further comprises:

a scraper, abutting a surface of the roller, configured to scrape waste ink from the roller when the roller rotates;

a liquid absorbent material, disposed below the scraper, configured to absorb liquid ink; and a capillary absorber material, disposed between the scraper and the liquid absorbent material, configured to receive and hold solid and semisolid ink materials, and to transmit liquid ink to the liquid absorbent material via capillary action.

7. An ink spittoon system in accordance with claim 5, wherein the drive mechanism further comprises:

a drive gear;

a motor, configured to rotate the drive gear;

a drive arm, attached to the drive gear, being pivotally moveable between an engaged position and a disengaged position; and a planet gear, attached to the drive arm and mechanically engaged with the drive gear, configured to engage the roller gear and transmit driving force from the drive gear to the roller gear when the drive arm is in the engaged position and the roller spittoon assembly is adjacent thereto, and to disengage from the roller gear when the drive arm is in the disengaged position.

8. An ink spittoon system in accordance with claim 7, wherein the drive arm is configured to pivot to the engaged position when the drive gear rotates in a first direction, and to pivot to the disengaged position when the drive gear rotates in a second direction.

9. An ink spittoon system in accordance with claim 5, wherein the media drum further comprises a transverse channel, the roller spittoon assembly being disposed in the channel, and further comprising a releasable mechanical latch, interconnecting the elongate body within the channel.

10. A removable roller spittoon cartridge for an ink jet printer, comprising:

an elongate body, removably mountable upon a media drum of the ink jet printer;

an elongate roller, disposed within the body, a top portion of the roller being exposed to a print head of the printer and configured to receive waste ink material ejected therefrom;

a roller gear, attached to the roller;

an ink collecting structure, disposed in the body below the roller; and a drive mechanism, configured to selectively rotate the roller to transfer waste ink material from the roller to the ink collecting structure, having a selectively engageable gear drive, configured to engage the roller gear and transmit driving force thereto when the roller spittoon assembly is adjacent to the drive mechanism.

11. A removable roller spittoon cartridge in accordance with claim 10, wherein the ink collecting structure further comprises:

a scraper, disposed within the elongate body, abutting a surface of the roller, configured to scrape waste ink from the roller when the roller rotates; and at least one absorbent material, disposed near the scraper, configured to receive and hold solid, semisolid, and liquid ink materials.

12. A removable roller spittoon cartridge in accordance with claim 11, wherein the at least one absorbent material comprises:

a capillary absorbent material, disposed near the scraper, configured to receive and hold solid and semisolid ink materials, and a liquid absorbent material, disposed adjacent to the capillary absorber material, configured to absorb liquid ink, the capillary absorbent material being configured to transmit liquid ink to the liquid absorbent material via capillary action.

13. A removable roller spittoon cartridge in accordance with claim 10, wherein the elongate body is configured to be disposed in a transverse channel in the media drum.

14. A removable roller spittoon cartridge in accordance with claim 10, further comprising a releasable mechanical latch, releasably interconnecting the elongate body to the media drum.

15. A method for handling waste ink in an ink jet printer, comprising the steps of:

ejecting waste ink from a print head of the ink jet printer onto a roller of a roller spittoon device mounted on a rotating media drum of the printer;

rotating the drum to position the roller spittoon device adjacent to a selectively engageable drive mechanism;

engaging the selectively engageable drive mechanism with a gear attached to the roller; and rotating the roller against a scraper of the roller spittoon device to remove waste ink from the roller.

16. A method in accordance with claim 15, further comprising the step of: depositing the waste ink into an ink collecting structure of the roller spittoon device.

17. A method in accordance with claim 16, wherein the step of depositing the waste ink into an ink collecting structure comprises the steps of:

absorbing solid and semisolid ink materials in a capillary absorbent material, disposed near the scraper; and transmitting liquid ink materials through the capillary absorbent material to a liquid absorbent material via capillary action.

18. A method in accordance with claim 16, further comprising the step of removing the roller spittoon device from the media drum after the ink collecting structure absorbs a predetermined waste ink capacity.

* * * * *